US010781528B2

(12) United States Patent
Yeh

(10) Patent No.: US 10,781,528 B2
(45) Date of Patent: Sep. 22, 2020

(54) COLORED METAL FILMS AND METHODS OF MANUFACTURING THEREOF

(71) Applicant: PrintGoal Technology Co., Ltd., New Taipei (TW)

(72) Inventor: Tsung-Chia Yeh, New Taipei (TW)

(73) Assignee: PRINTGOAL TECHNOLOGY CO., LTD., New Taipei (TW)

( * ) Notice: Subject to any disclaimer, the term of this patent is extended or adjusted under 35 U.S.C. 154(b) by 82 days.

(21) Appl. No.: 15/678,091

(22) Filed: Aug. 15, 2017

(65) Prior Publication Data

US 2017/0342586 A1 Nov. 30, 2017

Related U.S. Application Data

(62) Division of application No. 14/644,179, filed on Mar. 10, 2015, now Pat. No. 9,988,731.

(30) Foreign Application Priority Data

Mar. 10, 2014 (TW) ..... 103108123 A

(51) Int. Cl.

| | |
|---|---|
| ***C25D 11/02*** | (2006.01) |
| ***B41M 5/00*** | (2006.01) |
| ***C23F 1/02*** | (2006.01) |
| ***B41M 7/00*** | (2006.01) |
| *B41M 1/28* | (2006.01) |

(52) U.S. Cl.

CPC ..... *C25D 11/02* (2013.01); *B41M 5/0047* (2013.01); *B41M 5/0058* (2013.01); *B41M 7/00* (2013.01); *C23F 1/02* (2013.01); *B41M 1/28* (2013.01); *Y10T 428/24851* (2015.01)

(58) Field of Classification Search

CPC ... C25D 11/02; B41M 5/0047; B41M 5/0058; B41M 7/00; B41M 1/28; C23C 1/02

See application file for complete search history.

(56) References Cited

U.S. PATENT DOCUMENTS

2004/0194235 A1* 10/2004 Yan ..... B41M 5/24 8/522

* cited by examiner

*Primary Examiner* — Laura C Powers

(74) *Attorney, Agent, or Firm* — Cheng-Ju Chiang

(57) ABSTRACT

The present invention relates to a colored metal film comprising a metal article and a plurality of pores. The plurality of pores further comprises a high layer, an intermediate layer, and a low layer, in which the three layers together forms an embossed image. The present invention also relates to a method of manufacturing colored metal films. The method is used to manufacture a flat image or an embossed image on a metal article. The method comprises a finishing process, a first coating process, a color adjustment, a first printing process, an etching process, a second coating process, a second printing process, a sealing process, and a cleaning process.

2 Claims, 5 Drawing Sheets

COLORED METAL FILMS AND METHODS OF MANUFACTURING THEREOF

1. TECHNICAL FIELD

At least one embodiments of the present invention relates to colored metal films and the methods of manufacturing thereof. More particularly, at least one embodiments of the present invention relates to methods of printing images on a coating layer of a metal article.

2. DESCRIPTION OF THE RELATED ART

Metal articles used as packaging or cases are characterized in their light weight, long durability, and strong rust resistance, therefore they are commonly found as cell phone cases and laptop cases. Decoration on these accessories is frequently used to cover the nature hue of metal and give colors to the surface of metal. Dying, painting, spraying, transfer printing, and screen printing are the decoration techniques intensively used in this field. Applying these decoration techniques on metal articles can create colorful and splendid appearances.

However, dying, one of the most popular techniques, is infamous of not being environment-friendly. Metal articles are immersed in one dye vat to be affixed with one single pigment at a time, in which every dye vat used in the process will produce a significant volume of water and waste. Painting and spraying can easily apply rich colors on metal surfaces, but workers are required to put on masks to prevent inhaling the volatile toxins in paints. Another problem of paints is that wet paints are adhesive and dried paints are fragile. Paints contaminate or flake off easily when contact with other things if there is no protective layer coated on the paints. The protective layer, however, requires additional processes which will increase the production cost and lose the nature texture of metal. As for transfer printing, it can transfer a variety of patterns on metal articles, but the patterns are highly sensitive to abrasion. Patterns transferred on metal articles will bulge or even be peeled off easily under friction. Screen printing, on the other hand, is less flexible since it requires molds and permits only one color each time.

Most of the aforementioned decoration techniques are capable of decorating metal articles with flat patterns. And screen printing, unlike the other methods, can further introduce embossment-like patterns, formed of the dried paints, on metal articles. One of the reasons the market does not widely accept screen printing nowadays is, again, the low flexibility of screen printing. Embossment-like patterns crafted by screen printing give an impression of rigidity, and all the embossment-like patterns are in a same height.

In conclusion, the techniques used to in the art to decorate metal articles are full of defects. Some of the techniques are not environment friendly and some are inflexible. Accordingly, there is a need of improved colored metal films and a novel method of manufacturing colored metal films, in which the colored metal films are enriched with splendid colors and various patterns while maintaining the nature of metal.

SUMMARY

At least one embodiment of the present invention provides methods of manufacturing colored metal articles. The methods are environment-friendly and able to decorate metal articles with colorful images while maintaining the properties and texture of metal. Moreover, the images on the metal articles are highly durable, and the images can be designed as flat images or embossed images depending on the needs.

Some embodiments of the present invention provide methods of manufacturing colored metal films with flat images. The method starts with a finishing process to apply at least one type of surface finishes on a surface of a metal article and a coating process to coat a coating layer on the surface, in which the coating layer comprises a plurality of pores. A digital image then undergoes color adjustments to adjust the colors of the digital image and a printing process to print the digital image on the coating layer to generate a flat image. The printing process is performed with an inkjet printer and an aqueous ink. Since the coating layer is characterized by comprising the plurality of pores, the aqueous ink is able to be taken and accommodated in the plurality of pores. Furthermore, a sealing process and a cleaning process are applied on the plurality of pores to fix the aqueous ink and remove some of the aqueous ink not sealed in the plurality of pores.

In the finishing process, the surface finishes may be one selected from the group consisting of a grit finish, a polish finish, a sanded finish, a mirror finish, a satin finish, and a scratch finish. The surface finishes are applied on the surface of the metal article to generate a smooth surface or a patterned surface. The material of the metal article is preferred be one suitable for coating a coating layer on the surface. More particularly, the material of the metal article is one selected from the group consisting of steel, iron, aluminum, magnesium, zinc, titanium, copper, nickel, manganese, beryllium, tantalum, and the alloy thereof.

In the coating process, the coating layer is formed by a process selected from the group consisting of non-electrophoretic coating techniques (e.g., the chemical process) and electrophoretic coating techniques (e.g., the anodization process). The chemical process is applied with phosphate salt, chromate, or chromic salt to oxidize the surface of the metal article to form an oxide coating, in which the oxide coating and a plurality of pores thereof forms the coating layer. In the anodization process, the metal article at the anode electrode is immersed in an electrolyte. More particularly, the electrolyte is an organic acid solution selected from the group consisting of sulfuric acid, chromic acid, phosphoric acid, oxalic acid, citric acid, tartaric acid, and sulfonic acid. Once the electric current flows in the electrical circuit, the coating layer will form on the surface of the metal article. In some preferred embodiments, each pore of the plurality of pores is perpendicular to the surface of the metal article. The direction of openings helps the plurality of pores to take the aqueous ink into its inner space. On the contrary, if pores of the plurality of pores are slanting on the surface, the aqueous ink will be hindered by or leak from the plurality of pores and results in some influence on the printed images.

In the color adjustments, the digital image undergoes a sub-step of International Color Consortium (ICC) profile conversion, a sub-step of image retouching, and a sub-step of ink management. The color adjustments change an image into a form suitable for being printed on metal. Most images are clear on paper but not on metal. Colors are vivid when against a light background, but dim when on a medium with deep color and metallic luster. Variation between different displayers is another problem. For example, colors on a color input device from the client and a color output device from the service provider may be inconsistent, the printed images thus would depart from the expectation from the client. In more detail, the sub-step of ICC profile conversion refers to utilizing software to convert images in accordance with the ICC profiles of different applications. For example, each device has a specific ICC profile. Mapping the color spaces between two different devices (e.g., a displayer v. a printer, or a displayer from one brand v. another displayer from another brand) based on their ICC profiles could ensure that colors on two devices are consistent. The sub-step of image retouching refers to adjusting curve to modify the hue and brightness of some specific regions of images by using curve tools. The sub-step of image retouching also saturates colors to balance the influence from metallic luster, changes color temperature to reproduce the natural result on metal as on paper, enhances contrast to augment the differences between colors, and alters sharpness and brightness to improve the image clarity. The sub-step of ink management refers to controlling the ink load. Unlike paper, metal does not take dye efficiently and ink on metal is tending to overflow and mix with each other before the ink is all dried up. The sub-step of ink management regulates the amount of ink load jetted on the surface of the metal article to suppress the overflow of inks and the subsequent ink artifacts.

In the printing process, an inject printer will propel aqueous ink into the plurality of pores on the coating layer to illustrate the digital image on the surface of the metal article. Inkjet printing is more precise than spraying and more economical than dyeing. Inkjet printers utilize ink efficiently and can thus reduce the usage of ink. They are able to propel droplets into some specific pores of the plurality of pores and illustrate sophisticate images on metal articles.

In the sealing process, ink will be sealed in the plurality of pores. The sealing process is to immerse the metal article into hot water, chromate solution, boric acid solution, or acetate solution. An alternate process is to steam the metal article. During the sealing process, some of the oxide coating in the coating layer will be converted into hydrate forms and forms clogs to block the plurality of pores.

In the cleaning process, the excessive amount of ink will be removed. During the printing process and the sealing process, some ink not in the plurality of pores may adhere on the peripheral regions. Therefore, after the sealing process, the metal article will be cleaned by being immersed into or wiped with solvents such as banana oil and butanone to dissolve the excessive amount of ink.

Conventional methods of manufacturing colored metal films fail to introduce images as vivid as photos on metal. Most of the reason is that those methods rarely optimize the colors of digital images and are not trying to utilize inkjet printing. At least one embodiments of the present invention provides methods of manufacturing colored metal films in which the image quality is close to the images printed on paper.

Some embodiments of the present invention provide methods of manufacturing colored metal films with embossed images. The method starts with a finishing process to apply at least one type of surface finishes on a surface of a metal article and a first coating process to coat a first coating layer on the surface, in which the first coating layer comprises a first plurality of pores. A digital image then undergoes color adjustments to adjust the colors of the digital image and a first printing process to print the digital image on the first coating layer to generate a flat image. The first printing process is performed with an inkjet printer and an aqueous ink. Since the first coating layer is characterized by comprising the first plurality of pores, the aqueous ink is able to be taken and accommodated in the first plurality of pores. After the digital image was printed on the first coating layer, an etching process is applied to etch the surface of the metal article to generate differences in depth among the plurality of pores. A second coating process is applied to coat a second coating layer on the surface, in which the second coating layer comprises a second plurality of pores. After the second coating layer was formed, a second printing process is further performed to print the digital image on the surface to generate an embossed image, in which this process is performed with the inkjet printer and the aqueous ink. Since the second coating layer is characterized by comprising the second plurality of pores, the aqueous ink is able to be taken and accommodated in the second plurality of pores. A sealing process and a cleaning process are subsequently applied on the plurality of pores to fix the aqueous ink and remove some of the aqueous ink not sealed in the second plurality of pores.

One of the differences between the methods of manufacturing colored metal films with flat images and that with embossed images is the etching process. The step of corrosion uses corrosive chemicals to etch the oxide coating in the first coating layers. Some of the first plurality of pores, accommodating the aqueous ink, have higher resistance to the corrosive chemicals and some, with little or no aqueous ink, is more sensitive to the corrosive chemicals. After treated with corrosive chemicals for a moment, the difference resistances amongst the first plurality of pores will result in differences in depth among the plurality of pores. The subsequent coating process and printing process applied on the surface will generate embossed images on the metal article. The corrosive chemical used in the etching process is one selected from the group consisting of a hydrochloric acid solution, a hydrofluoric acid solution, a nitric acid solution, a sulfuric acid solution, a sodium hydroxide solution, a sodium carbonate solution, a sodium bicarbonate solution, a sodium sulfate solution and a phosphoric acid solution.

Conventional methods of manufacturing colored metal films fail to introduce embossed images with natural patterns on metal. The only method to manufacture embossment-like patterns is to use screen printing, which can merely introduce embossment-like patterns in a same height. At least one embodiments of the present invention provides methods comprising the etching process, the second coating process, and the second printing process to craft multi-layer images on metal articles.

Some embodiments of the present invention provide colored metal films having unique patterns. One of the embodied colored metal films is based on a metal article. The colored metal film comprises multiple pores on a surface of the metal article, and the multiple pores can be further divided into at least one high layer, at least one intermediate layer, and at least one low layer. More particularly, the high layer is a first subset of the multiple pores accommodating at least one first ink, the intermedia layer is a second subset of the multiple pores accommodating at least one second ink, and the low layer is a third subset of the multiple pores accommodating neither the at least one first ink nor the at least one second ink. The combination of the at least one high layer, the at least one intermediate layer, and the at least one low layer forms a multi-layer pattern on the surface of the metal article. The multi-layer patterns and the ink together generate embossed images.

At least one embodiment of the present invention provides methods of manufacturing colored metal articles. Images on the colored metal articles can be designed as flat images or embossed images and the images are illustrated by inkjet printing instead of conventional methods such as dyeing, spraying, or painting. The embodiments have several advantages. One of the advantages is that the methods are economical to run. Workers are not required to put on masks in the methods since less water, gas, and waste are produced and less dye are used. Another advantage is that the products can be recycled and re-forged into new products since the methods are fully compiled with the idea of reduce, reuse, recycle and recovery. Still another advantage is the high durability of the products, since the ink is protected by the oxide coating. The oxide coating is resistant to sunlight, rainfall, acid, abrasion, and scratch and is shatterproof and anti-static, it can protects the ink from various damages. The skin of the metal coating is smooth and easy to clean; it is an ideal medium to present vivid colors and detail images. Some embodiments also provide methods of manufacturing colored metal films with embossed images. The embossed images can imitate the natural texture and visual effect of wood, leather, stone, or porcelain. And the products can use to create a variety of customized mobile cases, business cards or even furniture.

DESCRIPTION OF THE PREFERRED EMBODIMENTS

Figure 1:
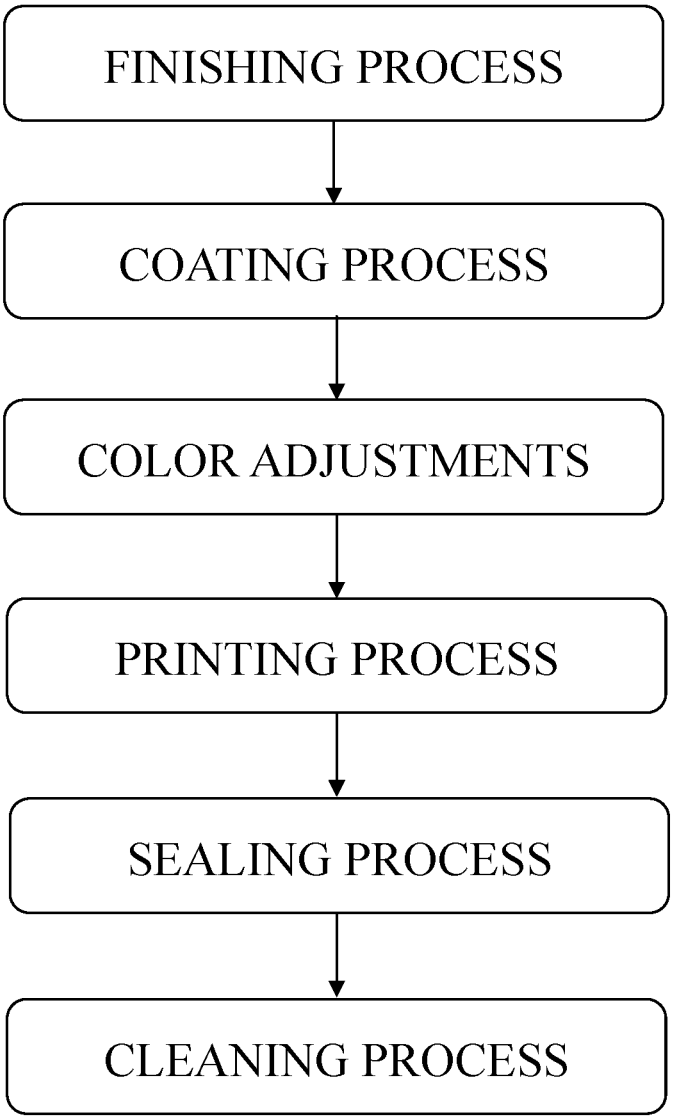
FIG. 1 is a flow diagram illustrating a method of manufacturing colored metal films with flat images, according to some embodiments of the present invention.

FIG. 1 is a flow diagram illustrating a method of manufacturing colored metal films with flat images, according to some embodiments of the present invention. In the embodiments, the method comprises a finishing process, a coating process, color adjustments, a printing process, a sealing process, and a cleaning process. In one embodiment, the exemplary metal article is an aluminum alloy. In the finishing process, the metal article is transferred to a polishing machine or a sander to craft a smooth surface or a hairline surface on the metal article. In the coating process, the metal article is subjected to anodization. To coat the metal article, the metal article is immersed in a 15-18 wt % sulfuric acid solution for 10-30 minutes and the anodizing condition is 15-20 V and 1-2 A/dm$^2$. After the coating process, an oxide coating with a thickness about 11-16 μm is formed on the metal article.

Figure 2:
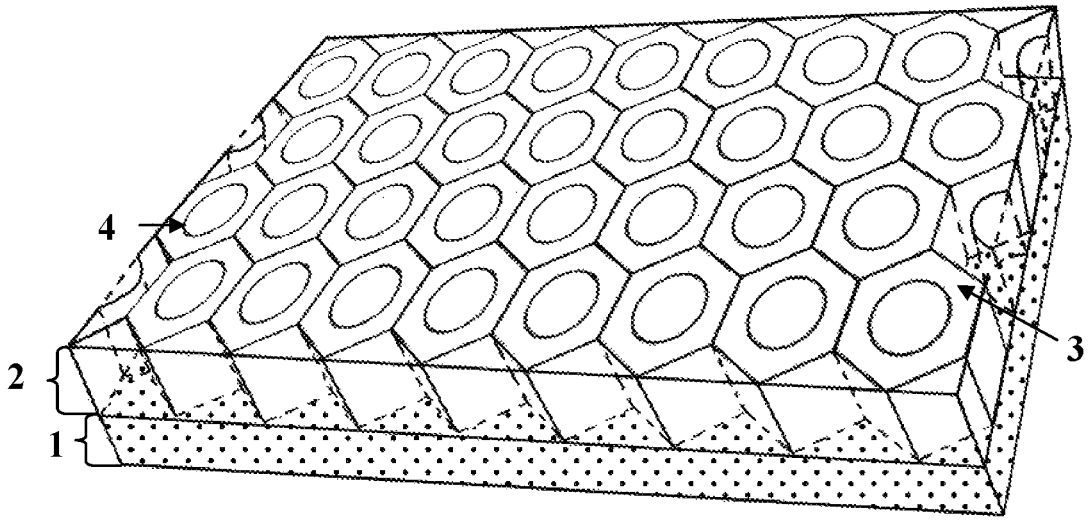
FIG. 2 is a schematic diagram illustrating a plurality of pores, according to some embodiments of the present invention.

FIG. 2 is a schematic diagram illustrating the plurality of pores, according to some embodiments of the present invention. The coating layer 2 on the metal article 1 is an oxide coating 3. The coating layer 2 comprises a plurality of pores 4, in which each pore of the plurality of pores 4 is perpendicular to the surface of the metal article 1. Referring to FIG. 1, in the color adjustments, software converts digital images in accordance with the ICC profile of the image input device. For example, converting a digital image in RGB profile to a digital image in CMYK profile. Photo editing software will further apply curve tool on some overexposed regions of the images, enhance the saturation of colors to cover the metallic color, alter the temperature and contrast to reproduce the natural color of the images, and increase the sharpness and brightness to improve image clarity. In one preferable embodiment, the lines of the images are clear even at a screen resolution of at least 800×600 pixels. Ink management software, on the other hand, will regulate the ink-load of each color.

In printing process, the metal article is transferred to an inkjet printer. The inkjet printer has a 0.1-0.5 μm nozzle diameter which can expel droplets at pico-liter scale (i.e., 1-2 pL per droplet). The aqueous ink, injected into the plurality of pores in the printing process, comprises 4-20% of a pigment, 15-30% of a glycol ether compound, 1-5% of a ketone compound, 60-75% of deionized water, 0.1-1% of an additive, and 0.01-0.1% of a surfactant. In the sealing process, the metal article is transferred to a steamer for steaming. The steaming condition is 85-100° C. for at least 30 minutes. During the sealing process, some oxide coating in the coating layer will be converted into the hydrate forms and form clogs to block the plurality of pores. In the cleaning process, butanone is used to clean the surface of the metal article by dissolving the excessive amount of ink remained on the surface.

Figure 3:
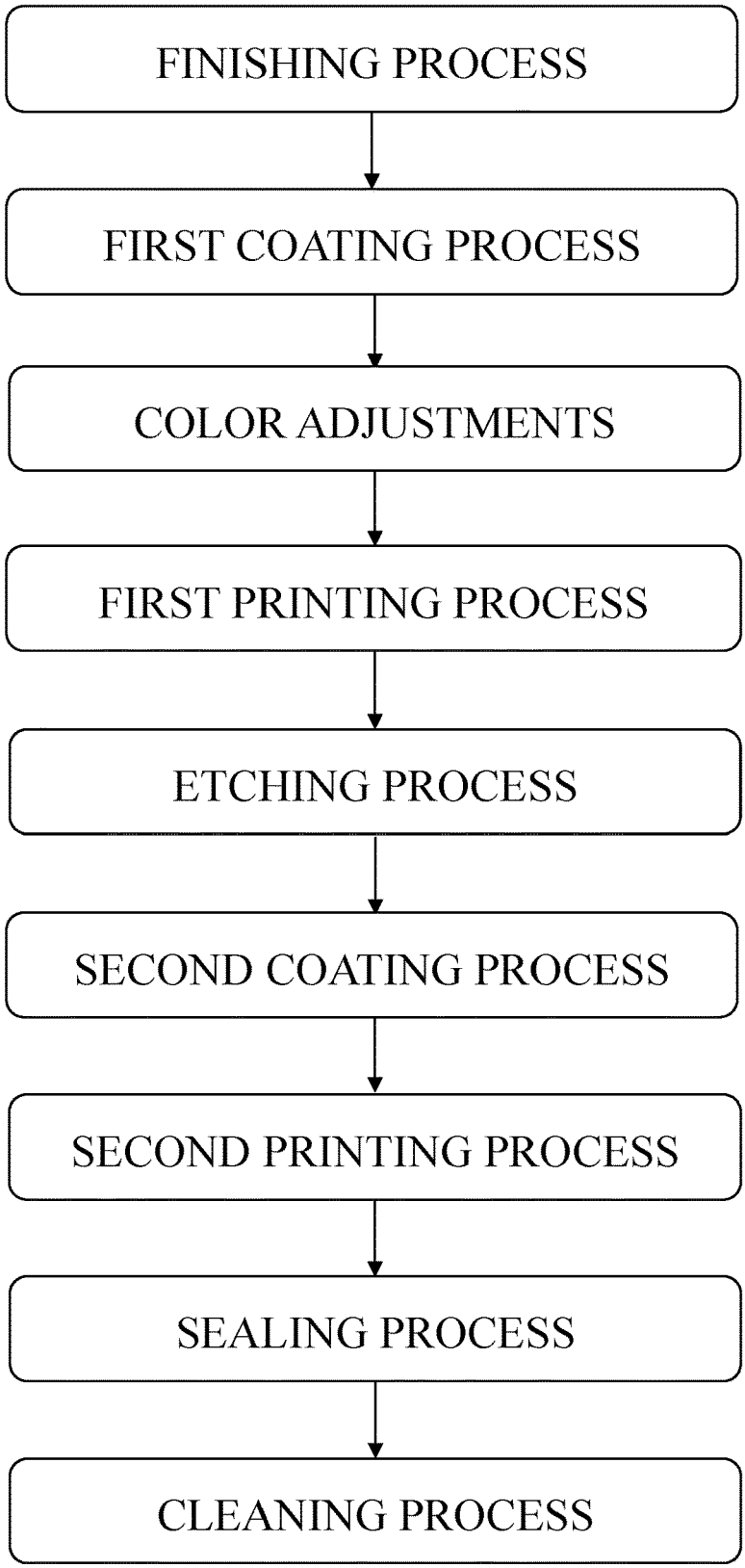
FIG. 3 is a flow diagram illustrating a method of manufacturing colored metal films with embossed images, according to some embodiments of the present invention.

FIG. 3 is a flow diagram illustrating a method of manufacturing colored metal films with embossed images, according to some embodiments of the present invention. In the embodiments, the method comprises a finishing process, a first coating process, color adjustments, a first printing process, an etching process, a second coating process, a second printing process, a sealing process, and a cleaning process. In one embodiment, the exemplary metal article is an aluminum alloy. In finishing process, the metal article is transferred to a polishing machine or a sander to craft a smooth surface or a hairline surface on the metal article. In the first coating process, the metal article is subjected to anodization. More particularly, the metal article is immersed in a 15-18 wt % sulfuric acid solution for 10-30 minutes and the anodizing condition is 15-20 V and 1-2 A/dm$^2$. After the first coating process, a first oxide coating with a thickness about 11-16 μm is formed on the metal article. The first coating layer comprises the first oxide coating and a first plurality of pores, in which each pore of the first plurality of pores is perpendicular to the surface of the metal article.

In the color adjustments, software converts digital images in accordance with the ICC profile of the image input device. For example, converting the digital images in RGB profile to digital images in CMYK profile. Photo editing software will further apply curve tool on some overexposed regions on the images, enhance the saturation of colors to cover the metallic color, alter the temperature and contrast to reproduce the natural color, and increase the sharpness and brightness to improve the image clarity. The images are preferred to a clear even at a screen resolution of at least 800×600 pixels. Ink management software, on the other hand, will regulate the ink-load of each color. In the first printing process, the metal article is transferred to an inkjet printer. The inkjet printer has a 0.1-0.5 μm nozzle diameter which can expel droplets at pico-liter scale (i.e., 1-2 pL per droplet). The aqueous ink, injected into the first plurality of pores in the first printing process, comprises 4-20% of pigment, 15-30% of a glycol ether compound, 1-5% of a ketone compound, 60-75% of deionized water, 0.1-1% of an additive, and 0.01-0.1% of a surfactant. More particularly, the printer separates images into four plates, each representing a color, and illustrates the four plates respectively.

Figure 4:
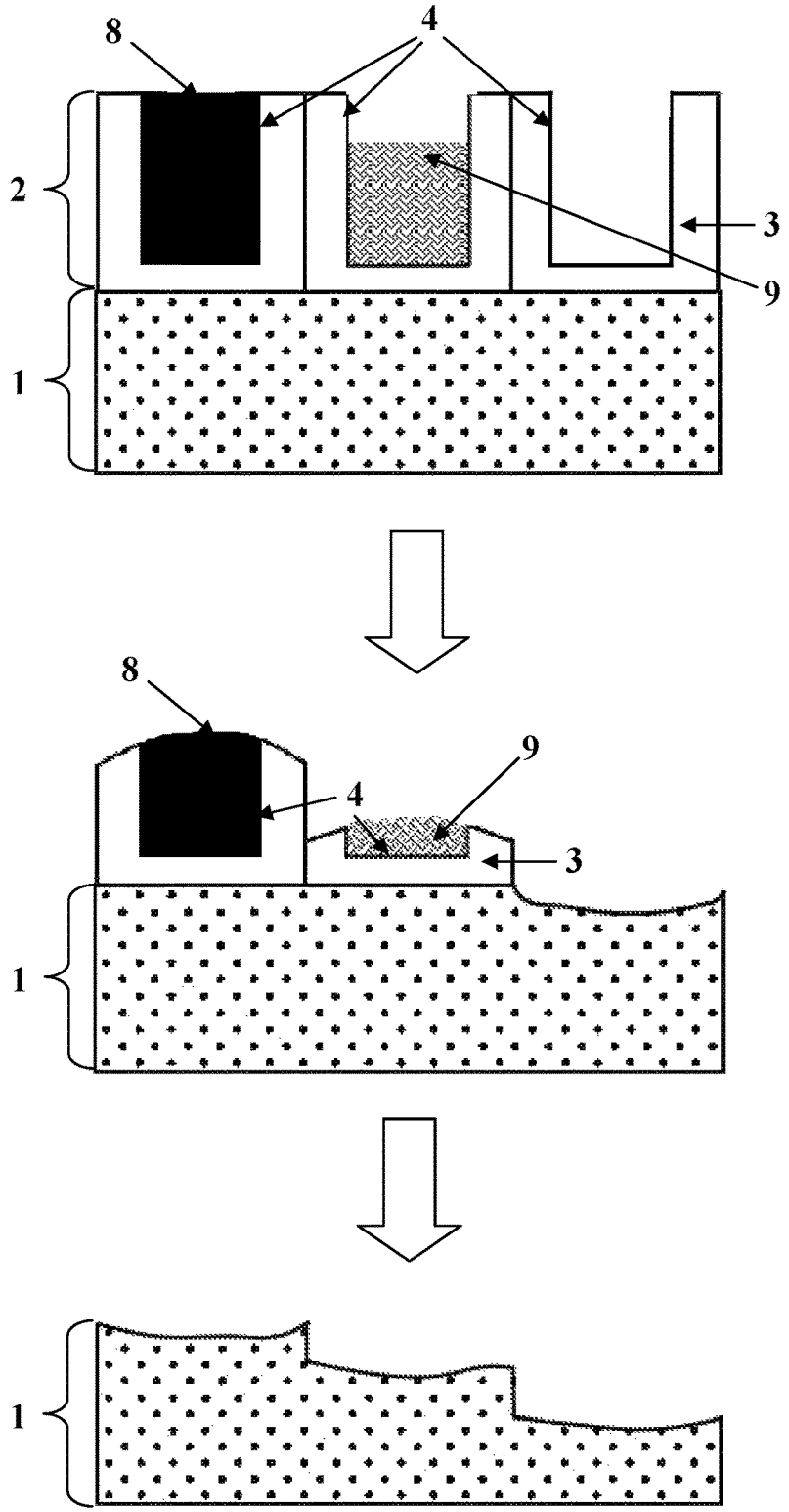
FIG. 4 is schematic diagrams illustrating the etching process in a method of manufacturing colored metal films, according to some embodiments of the present invention.

FIG. 4 is schematic diagrams illustrating the etching process in a method of manufacturing colored metal films, according to some embodiments of the present invention. After the first printing process, some of the first plurality of pores 4 is accommodating at least one first ink 8 (i.e., a deeper color) and some other of the first plurality of pores 4 is accommodating at least one second ink 9 (i.e., a lighter color). More particularly, the pores printed with a deeper color are filled with more aqueous ink than the pores printed with a lighter color. In the etching process, the first coating layer 2 is immersed in a 90% sodium hydroxide solution at 90° C. of for about 30 seconds to modify the surface of the metal article 1. Since the corrosion rate of regions covered by ink is slower than that of clean regions, the pores accommodating the at least one first ink 8 are consumed at a slower rate when compared with the pores accommodating the at least one second ink 9. After a period of time, the sodium hydroxide solution will remove all of the plurality of pores 4 and reach the surface of the metal article 1. However, based on the colors printed on the metal article 1, different regions of the metal article 1 will be reached by the sodium hydroxide solution at different rates and thus generated differences in depth among the plurality of pores and form an emboss-like pattern in accordance with the images printed on the surface of the metal article 1.

Figure 5:
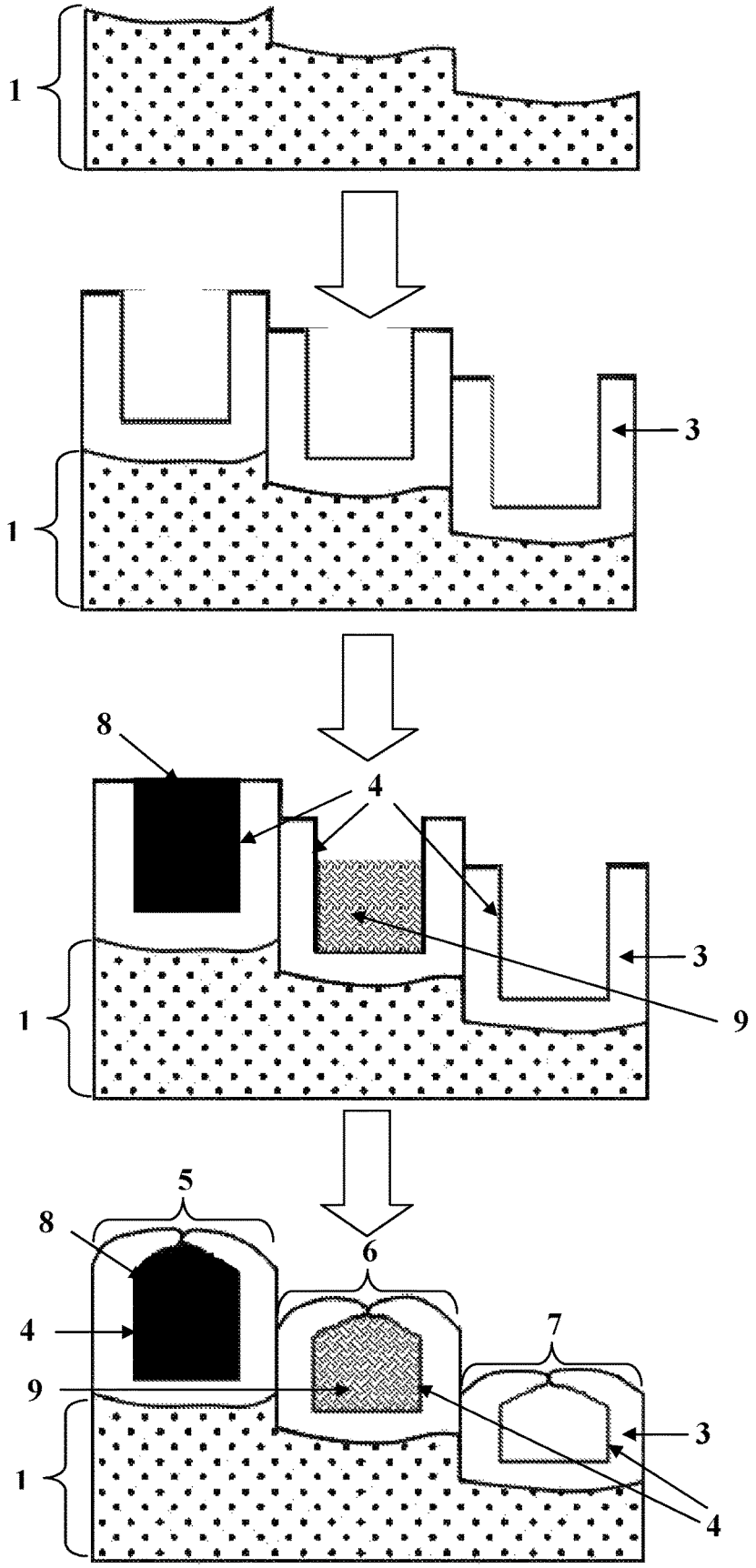
FIG. 5 is schematic diagrams illustrating the method of manufacturing colored metal films, according to some embodiments of the present invention.

FIG. 5 is schematic diagrams illustrating the method of manufacturing colored metal films, according to some embodiments of the present invention. In the second coating process, the metal article 1 is subjected to anodization to form the second coating layer on the surface. The metal article 1 is immersed in the 15-18 wt % sulfuric acid solution for 10-30 minutes and the anodizing condition is 15-20 V and 1-2 A/dm$^2$. After the second coating process, a second plurality of pores 4 has a height of 11-16 μm is formed on the metal article 1. Each pore of the second plurality of pores 4 is perpendicular to the surface of the metal article 1. In the second printing process, the metal article 1 is transferred to the inkjet printer to formed embossed images on the second plurality of pores 4. The second plurality of pores 4 can be divided into at least one high layer 5, at least one intermediate layer 6, and at least one low layer 7 after the second printing process. More particularly, the at least one high layer 5 comprises a first subset of the second plurality of pores 4 and accommodates at least one first ink, the at least one intermediate layer 6 comprises a second subset of the second plurality of pores 4 and accommodates at least one second ink, and the at least one low layer 7 comprises a third subset of the second plurality of pores 4 and accommodates neither the at least one first ink nor the at least one second ink. The at least one high layer 5, at least one intermediate layer 6, and at least one low layer 7 together form a multi-layer surface and the embossed images thus are created on the metal article 1.

In the sealing process, the metal article 1 is transferred to a steamer for steaming. The steaming condition is 85-100° C. for at least 30 minutes. And in the process, some oxide coating 3 in the coating layer 2 will be converted into the hydrate forms and form clogs to block the second plurality of pores 4. In the cleaning process, butanone is used to clean the surface of the metal article by dissolving the excessive amount of ink remained on the surface.

At least one embodiment of the present invention provides methods of manufacturing colored metal articles. Images on the colored metal films are illustrated by inkjet printing instead of conventional techniques such as dyeing and spraying. The embodiments have several advantages. One of the advantages is that the methods are environment-friendly and easy to run. More importantly, the methods are less harmful to workers. Another advantage is that the color adjustments and the printing process can produce vivid colors and detailed images. The etching process can further produce embossed images on the oxide coating. Still another advantage is that the method can create flat images and embossed images on metal articles while maintaining the high durability and light weight of metal.

There are many inventions described and illustrated above. The present inventions are neither limited to any single aspect nor embodiment thereof, nor to any combinations and/or permutations of such aspects and/or embodiments. Moreover, each of the aspects of the present inventions, and/or embodiments thereof, may be employed alone or in combination with one or more of the other aspects of the present inventions and/or embodiments thereof. For the sake of brevity, many of those permutations and combinations will not be discussed separately herein.

What is claimed is:

1. A colored metal film, comprising:

a metal article comprising an embossed-like pattern having differences in depth; and a coating layer comprising multiple sealed pores, anodized on the embossed-like pattern of the metal article, wherein the multiple sealed pores have the same differences in depth as the embossed-like pattern of the metal article;

the multiple sealed pores comprising a first subset of pores, a second subset of pores and a third subset of pores;

wherein the first subset of pores accommodates at least one first ink;

wherein the second subset of pores accommodates at least one second ink;

wherein the third subset of pores accommodates neither the at least one first ink nor the at least one second ink; and wherein the first subset of pores is higher than the second subset of pores, as the second subset of pores is higher than the third subset of pores;

wherein the color of the at least one first ink is darker than that of the at least one second ink;

wherein the first subset of pores is filled with more ink than the second subset of pores;

wherein the multiple sealed pores are perpendicular to the embossed-like pattern of the metal article.

2. The colored metal film according to claim 1, wherein the first subset of pores, the second subset of pores and the third subset of pores have a height between 11 μm and 16 μm.

* * * * *